United States Patent [19]

Nienart et al.

[11] 4,408,653

[45] Oct. 11, 1983

[54] METHOD FOR MAKING SERRATED METAL RIBBON

[75] Inventors: Louis F. Nienart, Bloomsbury; Richard G. Fehrman, Mine Hill, both of N.J.; Chung-Chu Wan, Diamond Bar, Calif.

[73] Assignee: Allied Corporation, Morris Township, Morris County, N.J.

[21] Appl. No.: 319,515

[22] Filed: Nov. 9, 1981

[51] Int. Cl.[3] ..... B22D 11/06

[52] U.S. Cl. ..... 164/463; 164/423

[58] Field of Search ..... 164/463, 479, 423, 427, 164/429; 148/403; 264/164, 165; 425/8

[56] References Cited

U.S. PATENT DOCUMENTS

| | | | |
|---|---|---|---|
| 3,710,842 | 1/1973 | Mobley et al. | 164/463 X |
| 3,904,344 | 9/1975 | Maringer et al. | 164/463 |
| 4,190,095 | 2/1980 | Bedell | 164/423 X |
| 4,197,146 | 4/1980 | Frischmann | 148/31.55 |
| 4,212,343 | 7/1980 | Narasimhan | 164/423 X |

*Primary Examiner*—Kuang Y. Lin

*Attorney, Agent, or Firm*—Michael J. Weins; Gerhard H. Fuchs

[57] ABSTRACT

A method for producing serrated ribbon or shard is described. Metal is cast onto a grooved chill surface where the grooves are at an inclination of between about 25° to 70° with respect to the direction of motion of the chill surface.

5 Claims, 3 Drawing Figures

METHOD FOR MAKING SERRATED METAL RIBBON

DESCRIPTION

1. Field of Invention

The present invention relates to a method for jet casting metallic ribbon, and more particularly to a method for producing serrated ribbon and/or shard.

2. Background Art

U.S. Pat. No. 3,710,842 issued to Mobley et al teaches that by providing grooves or mounds on a chill surface which are substantially transverse to the direction of travel of the chill surface it is possible to directly cast subdivided filaments.

While this technique has been demonstrated by Mobley et al to provide a method for the production of subdivided high sectional modulus filaments cast in channels which intersect the mounds or grooves, it has been found that grooves placed in a flat chill substrate tend to destabilize the stream and made casting of short filament sections unpredictable. Channels used in conjunction with the grooves, as was the case for all the examples given in the Mobley et al patent, help maintain the stability of the stream during casting.

The magnitude of the problem of stabilization of the impinging stream will be a function of many variables, however, in general the transverse grooves tend to destabilize the stream, and at a minimum this destabalization produces regions where the casting is not in contact with the chill surface. These noncontact regions produce a variation in the solidification rate which promotes inhomogeneities in the chemistry and/or structure of the resulting casting.

U.S. Pat. No. 4,212,343 issued to Narasimhan discloses the use of chill surfaces having protuberances and/or indentations. These surfaces when used with a slotted nozzle produced contoured continuous metal strip. This patent teaches away from adding protuberances and/or indentations to reduce the thickness of the resulting ribbon.

U.S. Pat. No. 4,197,146 issued to Frischmann discloses a method for producing oblated spheriods by employing insulating regions on the chill surface to mask regions over which solidification will not occur. The incorporation of the insulting material into the wheel surface makes resurfacing of the wheel difficult.

SUMMARY OF INVENTION

The present invention provides an improved method for casting serrated ribbon or shard on a grooved chill surface. The improvement comprises providing at least one groove in the chill surface which is orientated at an angle between about 25° and 70° with respect to the direction of travel of the chill surface.

BRIEF DESCRIPTION OF THE DRAWINGS

FIG. 2.1 is a schematic representation of a serrated ribbon produced by practicing the present invention.

FIG. 2.2 is a schematic representation of shard produced by practicing of the present invention.

BEST MODE OF CARRYING THE INVENTION INTO PRACTICE

Figure 1:
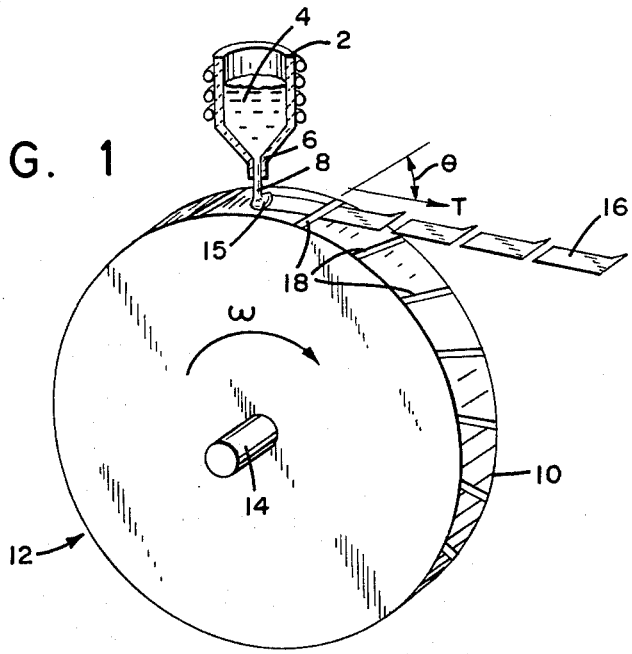
FIG. 1 is a schematic representation of a jet casting system for practicing the present invention.
Figure 1:
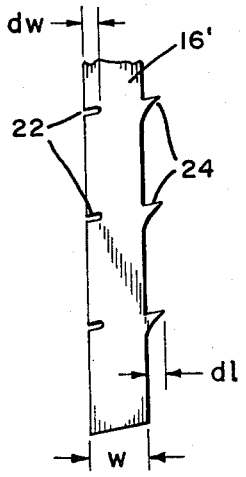
Figure 1:
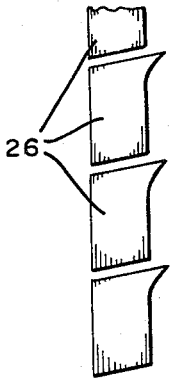

FIG. 1 illustrates a jet caster which is suitable for practicing the present invention. A crucible 2 containing the melt 4 is pressurized. The melt 4 flows through an orifice 6 to produce a metal stream 8. The stream 8 impacts the chill surface which is the peripheral edge 10 of a chill wheel 12. The wheel 12 is rotated about its axis 14. The metal stream 8 forms a puddle 15 where the stream 8 contacts the peripheral edge 10, and a ribbon 16 is formed as the perpherical edge 10 extracts metal from the puddle 15. For the present invention the peripheral edge 10 has inscribed grooves 18 which are at an angle $\theta$ with respect to the direction of travel, T, of the chill surface. In the case of a casting wheel, as illustrated in FIG. 1, the direction T is parallel to the peripheral edge 10 at the point where the molten metal stream 8 contacts the wheel.

The invention will be discussed in terms of a casting wheel, but applies to other chill geometries. The angle $\theta$ as defined above, maintains significance when the chill surface is a belt or other moving chill surface. For belt chill surfaces, the direction of travel, T will be the direction of motion of the belt.

The grooves 18 are regions which entrap gas when the casting is done in an atmosphere. The grooves 18 prevent molten metal from contacting the chill surface at the location of the grooves, and thereby retard the local solidification rate of the ribbon 16. Since the grooves 18 are not normal to the direction of travel of the peripheral edge 10, they have a component of their length parallel to the rotational movement, T of the peripheral edge 10. This parallel component permits gas to flow through the grooves 18 when casting is done in an atmosphere. The gas flow rate is a function of the surface speed of the peripheral edge 10, the angle between the direction of motion T and the groove 18, and the groove geometry. This gas flow aides in floating the metal puddle 15. Since the metal puddle 15 is rejecting metal in the direction of travel of the chill surface, the rejected metal moves along the grooves 18 forming serrations in the ribbon 16. The depth of the grooves 18 in the wheel should preferably be between about one and three times the thickness of the ribbon 16. When the grooves 18 are shallower than about the thickness of the ribbon 16, the gas flow does not appear to be sufficient to float the metal above the grooves 18; and, if the depth is greater than about three times the thickness of the ribbon 16, the gas flow will tend to destabilize the stream 8.

FIG. 2.1 shows a schematic representation of a ribbon 16' which was produced using a casting wheel 12 with grooves 18. The resulting ribbon 16' is serrated as illustrated. The serrations 22 result from the liquid metal being translated to form extensions 24. The extentions 24 on the serrated ribbon 16' are useful when one wishes to convert the ribbon 16' to powder by pulverization. The extentions 24 upon fracture will provide more fines than would ribbon without the extensions. The relative displacement (e.g., the ratio of extention length dl to ribbon width w) has been found to be a function of the velocity of the peripheral edge 10. When the velocity becomes sufficiently high, the ribbon will be divided into individual segments 26 as is illustrated in FIG. 2.2. When a continuous ribbon is desired, it is preferred that the speed of the chill surface be maintained below about 3500 fpm (17.8 mps). To maintain substantial serration depth dw, it is preferred that the surface speed be maintained at or above about 2500 fpm (12.8 mps). When individual shards are desired, it is preferred that the chill surface velocity be maintained between about 3500 fpm (17.8 mps) and 6000 fpm (30.6 mps).

The angle $\theta$ is critical for practicing the invention. As $\theta$ approaches 90° as is taught in the Mobley et al. patent, the grooves destabilizes the stream. For this reason, it is preferred that the angle $\theta$ be maintained below about 70° to assure that a ribbon forms which makes good contact with the chill surface. It should also be noted that at small $\theta$ the displacement will be small, and the resulting ribbon will have only shallow serrations. Therefore, it is preferred that for large serrations which facilitate fracture of the ribbon into segments, the angle $\theta$ be not less than 25°. For the above reasons, the angle $\theta$ should be between about 25° and 70° and preferably at about 45°.

In order to illustrate the improvement of the present invention a series of castings were made in air on a casting apparatus similar to that shown in FIG. 1 and described above.

EXAMPLES I–XVI

The alloy cast was a nickel base alloy ($Ni_{55.5}Mo_{24}Fe_{10}B_{10.5}$, subscripts atomic percent). The alloy was jet cast onto 15 inch (38.1 cm) diameter CuBe wheels which were water cooled. All wheels employed had grooves on the casting surface, and the groove separations were 0.5 inch (1.27 cm). The pressure maintained above the melt, the orifice diameter and length, the groove depth and width, surface speed of the chill surface, and the angle of inclination of the grooves with respect to the translational vector of the chill surface for each casting condition is summarized in Table 1. Table 2 reports normalized serration depths, dw/w where, dw is the serration depth, and w is the ribbon width as illustrated in FIG. 2.1. Table 2 also contains a brief description of the resulting ribbon and the condition of the puddle.

All ribbons cast had a width of about 0.03 inch (0.76 cm) to 0.1 inch (0.25 cm), and the thickness of the ribbons varied between about 1 mil (0.0025 cm) and 5 mil (0.0125 cm).

TABLE 1

Operating Conditions for Grooved Wheels with Groove Spacing ½ in (1.27 cm)

| | | Orifice | | Groove | | Surface | |
|---|---|---|---|---|---|---|---|
| Exp. | Pressure kPa | Diameter cm | Length cm | Depth cm | Width cm | Speed mps | 0 Deg. |
| 1 | 13.8–20.7 | 0.089 | 0.56 | 0.0127 | 0.0254 | 17.8 | 90 |
| 2 | 13.8–20.7 | 0.089 | 0.56 | 0.0127 | 0.0254 | 17.8 | 45 |
| 3 | 13.8–20.7 | 0.089 | 0.56 | 0.0076 | 0.0203 | 15.3 | 70 |
| 4 | 6.9–13.8 | 0.135 | 0.56 | 0.0076 | 0.0203 | 10.2+ | 75 |
| 5 | 6.9–13.8 | 0.135 | 0.56 | 0.0127 | 0.0254 | 25.5 | 45 |
| 6 | 6.9–13.8 | 0.135 | 0.56 | 0.0127 | 0.0254 | 17.8 | 45 |
| 7 | 6.9–13.8 | 0.135 | 0.56 | 0.0127 | 0.0254 | 12.75 | 45 |
| 8 | 13.8–20.7 | 0.076 | 0.56 | 0.0076 | 0.0203 | 25.5 | 45 |
| 9 | 13.8–20.7 | 0.076 | 0.56 | 0.0076 | 0.0203 | 17.8 | 45 |
| 10 | 13.8–20.7 | 0.076 | 0.56 | 0.0076 | 0.0203 | 12.75 | 45 |
| 11 | 6.9 | 0.135 | 0.56 | 0.0127 | 0.0254 | 25.5 | 45 |
| 12 | 6.9 | 0.135 | 0.56 | 0.0127 | 0.0254 | 17.8 | 45 |
| 13 | 6.9 | 0.135 | 0.56 | 0.0127 | 0.0254 | 12.75 | 45 |
| 14 | 13.8–20.9 | 0.089 | 0.56 | 0.0076 | 0.0203 | 17.8 | 45 |
| 15 | 13.8–20.9 | 0.089 | 0.56 | 0.0127 | 0.0254 | 17.8 | 45 |
| 16 | 13.8–20.9 | 0.089 | 0.56 | 0.0254 | 0.0254 | 17.8 | 45 |

TABLE 2

Description of Material Produced Under Conditions of Table 1

| Experiment | dw/w | Description of Cast Material and Puddle |
|---|---|---|
| 1 | NA | unstable puddle (splattered) |
| 2 | 0.8 | stable puddle (shard 1.27 cm) |
| 3 | <0.7 | stable puddle (continuous ribbon) |
| 4 | NA | unstable puddle (splattered) |
| 5 | 0.9 | stable puddle (shard 1.27 cm) |
| 6 | 0.5 | stable puddle (continuous ribbon) |
| 7 | 0.4 | stable puddle (continuous ribbon) |
| 8 | 0.9+ | stable puddle (shard 1.27 cm) |
| 9 | 0.7 | stable puddle (shard variable length) |
| 10 | 0.3 | stable puddle (continuous ribbon) |
| 11 | 0.7 | stable puddle (shard 1.27 cm) |
| 12 | 0.44 | stable puddle (continuous ribbon) |
| 13 | 0.3 | stable puddle (continuous ribbon) |
| 14 | 0.7 | stable puddle (shard variable length) |
| 15 | 0.8 | stable puddle (shard 1.27 cm) |
| 16 | NA | unstable puddle (splatter) |

As can be seen from examination of Table 2, attempts to cast ribbon in air where the angle $\theta$ was greater than about 70° (eg. examples I and IV) produced an unstable puddle which made it impossible to cast ribbon or shards. However, when the angle $\theta$ was reduced to 45°, a stable puddle existed for various surface speeds and groove geometries.

A stable puddle also occured when the angle $\theta$ was decreased to about 70° with respect to the direction of travel of the chill surface as illustrated by Example III. Again, as the angle $\theta$ decreased to about 45°, it was found that the puddle becomes very stable and that either continuous ribbon, or uniform shard can be obtained. In general, under operating conditions where $\theta$ was 45°, the chill surface velocity and groove configuration will determine the character of the resulting casting. For the groove geometries employed for Examples I–XVI which were at a chill surface velocity of 2500 fpm (12.75 mps) or less the ribbon was continuous, while at 5000 fpm (25.5 mps) the material cast as shards having a length equal to the separation of the grooves on the casting surface. These conditions will prevail until the depth of the grooves exceeds about 0.005 inch (0.0127 cm) in depth which is about twice the thickness of the ribbon or shard cast. Furthermore, the effect of groove depth on the dw/w ratio appears to be minimal for groove depths where a stable puddle can be maintained.

Examples XI–XIII illustrate the effect of wheel velocity on the extension, dw. In general, as the velocity increases, it is preferred for separation shard to be generated than velocity in excess of 3500 fpm (17.8 mps) be employed.

EXAMPLES XVII–XXIV

The same alloy as used in Example I–XVI was employed for casting. The alloy was cast onto 15 inch (38.1 cm) in diameter CuBe wheels which were water cooled. The wheels employed had 8 grooves equally spaced in the casting surface. For all castings, the following parameters were held constant.

Pressure over the melt: 2–3 psi (13.8–20.7 kPa)
Oriface diameter: 0.035 inch (0.084 cm)
Oriface Length: 7/32 inch (0.56 cm)
Groove Depth: 0.005 inch (0.0127 cm)
Groove Width: 0.010 inch (0.025 cm)

The angle $\theta$ made between the direction of motion of the chill surface, and the grooves, was systematically varies as set forth in Table 3. The wheel speed was increased in steps of 500 fpm (2.55 mps) over the range of 3000 fpm (15.3 mps) to 6000 fpm (30.6 mps). The description of the cast material and puddle conditions are summarized in Table 3.

TABLE 3

| | Effect of angles $\theta$ on puddle stability | |
|---|---|---|
| Example | $\theta$ | Description of puddle and resulting cast material |
| 17 | 30 | stable puddle - continuous ribbon |
| 18 | 35 | stable puddle - continuous ribbon |
| 19 | 40 | stable puddle - intermediate breaks along grooves |
| 20 | 45 | stable puddle - intermediate breaks along grooves |
| 21 | 50 | stable puddle - intermediate breaks along grooves |
| 22 | 55 | stable puddle - intermediate breaks along grooves |
| 23 | 60 | stable puddle - continuous ribbon |
| 24 | 65 | stable puddle - continuous ribbon |

It was found that, for the angles 0, 30, 35, 60 and 65, the ribbon was continuous for all speeds. For the remaining cases, the breakages increased with velocity, and approached 50% breakage (the ribbon parted at ½ the indentations) at about 6000 fpm (30.6 mps).

The higher speed for continuous ribbon results from the increase in the groove separation. This increase gives greater contact between the ribbon and the wheel, and reduces the turbulent air flow over the casting surface. These factors increase the quenching rate of the metal cast over the grooves, thereby reducing the displacement of the metal.

What we claim is:

1. In a method of melt spinning or casting metal ribbon wherein a stream of molten metal is impinged on a chill surface and is ejected from the surface by centrifugal force in the form of a metal filament, the improvement comprising providing at least one groove in the chill surface, the longitudinal axis of said groove run transverse to and is orientated at an angle between about 25° and 70° with respect to the direction of travel of the chill surface.

2. The method of claim 1 wherein the surface speed of the chill surface with respect to the stream is between about 2500 fpm (12.8 mps) and 3500 fpm (17.8 mps) thereby producing a serrated ribbon.

3. The method of claim 1 wherein the surface speed of the chill surface with respect to the stream is between about 3500 fpm (17.8 mps) and 6000 fpm (30.6 mps) thereby producing individual shards of ribbon.

4. The method of claim 2 or 3 wherein said groove has depth greater than the ribbon thickness and less than 3 times the thickness of the ribbon.

5. The method of claim 1 wherein said groove is oriented at an angle of about 45° with respect to the direction of travel of the chill surface.

* * * * *